US010939768B2

(12) United States Patent
Singer

(10) Patent No.: US 10,939,768 B2
(45) Date of Patent: Mar. 9, 2021

(54) PHYSICAL ACTIVITY DEVICES

(71) Applicant: CSS-FOOTFIDGET, Lake Zurich, IL (US)

(72) Inventor: Roberta D. Singer, Lake Zurich, IL (US)

(73) Assignee: CSS-FOOTFIDGET, Lake Zurich, IL (US)

( * ) Notice: Subject to any disclaimer, the term of this patent is extended or adjusted under 35 U.S.C. 154(b) by 0 days.

(21) Appl. No.: 16/372,182

(22) Filed: Apr. 1, 2019

(65) Prior Publication Data

US 2020/0305611 A1 Oct. 1, 2020

(51) Int. Cl.

| | |
|---|---|
| ***A47C 16/02*** | (2006.01) |
| ***A47B 97/00*** | (2006.01) |
| *A63B 21/055* | (2006.01) |

(52) U.S. Cl.

CPC ..... *A47C 16/02* (2013.01); *A47B 97/00* (2013.01); *A47B 2200/0097* (2013.01); *A63B 21/0552* (2013.01)

(58) Field of Classification Search

CPC ..... A47C 16/02; A47C 16/025; A47B 97/00; A47B 2200/0097; A63B 21/0552

See application file for complete search history.

(56) References Cited

U.S. PATENT DOCUMENTS

| | | | | |
|---|---|---|---|---|
| 47,931 | A | 5/1865 | Hussy | |
| 402,130 | A | 4/1889 | Bedford | |
| 1,529,175 | A | 3/1925 | Dunn | |
| 2,407,646 | A | 9/1946 | Best | |
| 2,606,593 | A | 8/1952 | Beurskens | |
| 4,676,174 | A | 6/1987 | Dingeldey | |
| 4,765,005 | A | 8/1988 | Hippel | |
| 4,852,875 | A | 8/1989 | McLennan et al. | |
| 5,207,481 | A * | 5/1993 | Ayala, Jr. | A47D 15/006 297/423.4 |
| 5,620,397 | A | 4/1997 | Chieh | |
| 5,690,383 | A * | 11/1997 | Meeker | A47D 13/107 297/274 |
| 7,452,034 | B2 | 11/2008 | Jung | |
| 7,549,705 | B2 | 6/2009 | Man et al. | |
| 7,565,869 | B2 | 7/2009 | Daniel | |
| 7,611,207 | B2 | 11/2009 | Barfuss | |
| 7,740,566 | B2 | 6/2010 | Nativ | |
| 8,061,278 | B2 | 11/2011 | Skiba | |
| 8,434,824 | B2 * | 5/2013 | Spinabella | A47B 97/00 108/50.14 |
| 9,339,679 | B2 * | 5/2016 | Ertl | A47B 41/00 |
| 2003/0228944 | A1 | 12/2003 | Scruby | |

* cited by examiner

*Primary Examiner* — Philip F Gabler

(74) *Attorney, Agent, or Firm* — Leber IP Law; Celia H. Leber

(57) ABSTRACT

The disclosure features physical activity devices that include (a) a central footrest, configured to receive at least a portion of a foot of a user, (b) a plurality of elongated sleeves, each sleeve having an inner and an outer surface, and being configured to at least partially enclose an elongated tubular support member, and having spaced grooves in its outer surface extending generally perpendicular to a longitudinal axis of the sleeve, and (c) at least two loops extending from the footrest, the loops being configured to be received by the grooves so that the sleeves support the footrest above a surface on which the tubular support members are positioned. The disclosure also features methods of using such devices.

26 Claims, 5 Drawing Sheets

PHYSICAL ACTIVITY DEVICES

BACKGROUND

Young students, for example in classes from fourth grade in a grammar school, to seniors in their fourth year of high school, tend to possess excess energy, which can prevent students from focusing their attention on the academic material being presented to them by their teacher. Some students are very sluggish and tend to lay their heads on their desk or prop themselves up on their elbows. Other students are so filled with energy that they are unable to stop fidgeting or bothering their neighbors and preventing them from having their attention on what the teacher is presenting to the class.

Studies have suggested that students' learning may be improved as a result of greater comfort and alteration of the desk, for example permitting the student to stand while using the classroom desk. Among the results reported from studies are that activity permissive classrooms, including standup desks, or sitting desks, combined with constructive fidgeting, give the children the flexibility they need to expend energy and at the same time focus better on their work as compared with students monitored while using traditional desks. Moreover, teachers in several states have reported that they know from experience that standup desks facilitate the student's need to expend energy and at the same time focus better on their scholastic work rather than focusing on how to sit still or keep still.

U.S. Pat. No. 8,434,824, the full disclosure of which is incorporated herein by reference, proposes a universal foot assembly having a foot rest with four points of attachment by elastic bands. A product embodying the disclosure of U.S. Pat. No. 8,434,824 has been sold under the tradename FOOTFIDGET®. The foot assembly may be attached to a desk or work-station for use either sitting or standing, and can be adjustably configured to allow the foot rest to vibrate, rotate, or move in a number of directions, to provide resistive movement (proprioception) in an ergonomically correct position, helping students to expend nervous energy. The device is strategically positioned in the middle of the desk foot space to ensure proper ergonomic and postural alignment for the user. However, the inventors have found that in practice this device can be difficult to install, and cannot be easily moved from one desk to another as needed. It can also be difficult to adjust the height of the foot rest quickly and accurately to meet the needs of different students.

SUMMARY

In one aspect, the present disclosure features a physical activity device that includes (a) a central footrest, configured to receive at least a portion of a foot of a user, (b) a plurality of elongated sleeves, each sleeve having an inner and an outer surface, and being configured to at least partially enclose an elongated tubular support member, and having spaced grooves in its outer surface extending generally perpendicular to a longitudinal axis of the sleeve, and (c) at least two loops extending from the footrest, the loops being configured to be received by the grooves so that the sleeves support the footrest above a surface on which the tubular support members are positioned.

Some implementations include one or more of the following features. Each sleeve may be configured to extend only partially around the circumference of the tubular support member. For example, each sleeve can be configured to extend around from about 45 percent to 55 percent of the circumference of the tubular support member. The tubular support member may be, for example, a desk or table leg, such as the leg of a student desk. In some cases, the desk or table leg includes a swivel foot, and each sleeve is configured to rest on top of each swivel foot. Each sleeve may have an outer surface the cross-section of which is an open rectangle or square, and an inner surface that is arcuate (e.g., semi-circular or semi-oval) in cross-section. For example, the cross-sectional shape of the inner surface may be a semicircle, so that the inner surface is configured for contact with the tubular support member. The sleeve may, for example, include at least three grooves. In some implementations, the device includes four sleeves and the loops provide four attachment points when the loops are positioned in the grooves. The loops may extend from or be part of one or more straps which are preferably formed of elastic cord or other resilient material. The grooves may be spaced from 1 to 2 hes apart, e.g., from 1.25 to 1.75 inches apart, and the sleeve may be from about 6 to 10 inches long, e.g., from about 7 to 9 inches long.

In another aspect, the disclosure features a method that includes attaching a physical activity device having a central footrest to a support structure having three or more vertically extending tubular support members. The device is attached by (a) placing an elongated sleeve around each of the support members, the elongated sleeve including two or more grooves extending generally perpendicular to a longitudinal axis of the sleeve, and (b) placing a loop connected to the footrest around each of the sleeves such that the loop is retained in one of the grooves and the footrest is supported above a surface on which the tubular support members are positioned.

Some implementations include one or more of the following features. Each loop may be placed in a groove at the same vertical height above a surface on which the support structure is positioned. Each sleeve can be open on one side, so that the sleeve can be mounted on the support member using a lateral motion relative to a longitudinal axis of the support member. The method may also include adjusting the height of the footrest relative to a surface on which the support structure is positioned by moving the loops to different grooves in each sleeve. In cases in which the support members include swivel feet, e.g., when the support structure is a student desk, the sleeves may be positioned on the support members such that a lower terminal surface of each sleeve rests on an upper surface of the corresponding swivel foot. The method may also include removing the physical activity device from the support structure by removing the sleeves from the support members. In some cases, the method may include then attaching the device to a different support structure.

Advantageously, in many implementations the physical activity devices disclosed herein can be easily attached to and removed from desks and other support structures without the need for tools or assembly skills. Moreover, the height of the footrest relative to the floor or ground can be quickly and easily adjusted whenever necessary, and can be easily set so that all attachment points of the device are at the same height. In preferred implementations, the device is designed to strategically position the footrest in the middle of the desk foot space to ensure proper ergonomic and postural alignment for the user.

Other features and advantages of the invention will be apparent from the following detailed description and from the claims.

DETAILED DESCRIPTION

Physical Activity Devices

Figure 1:
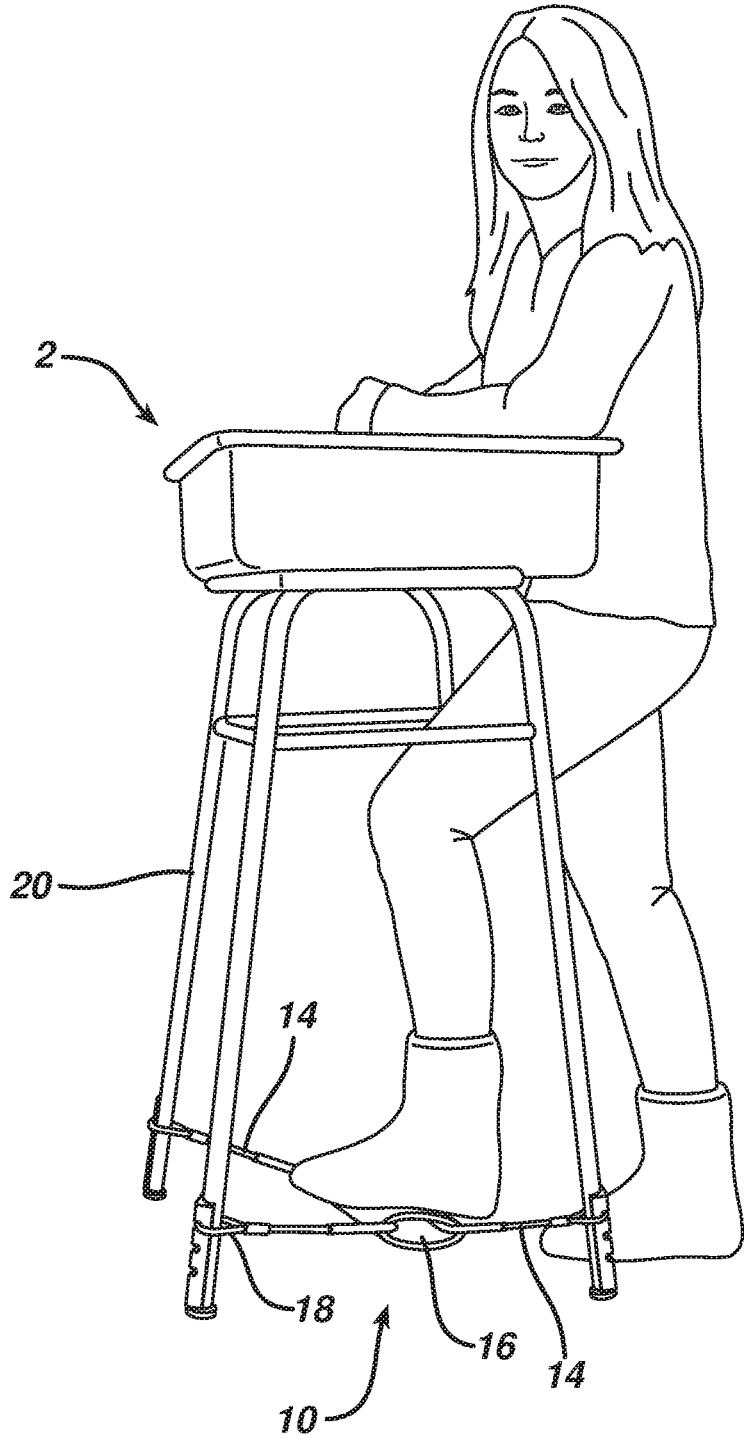
FIG. 1 is a perspective view of a physical activity device according to one implementation, in use on a student desk.
Figure 2:
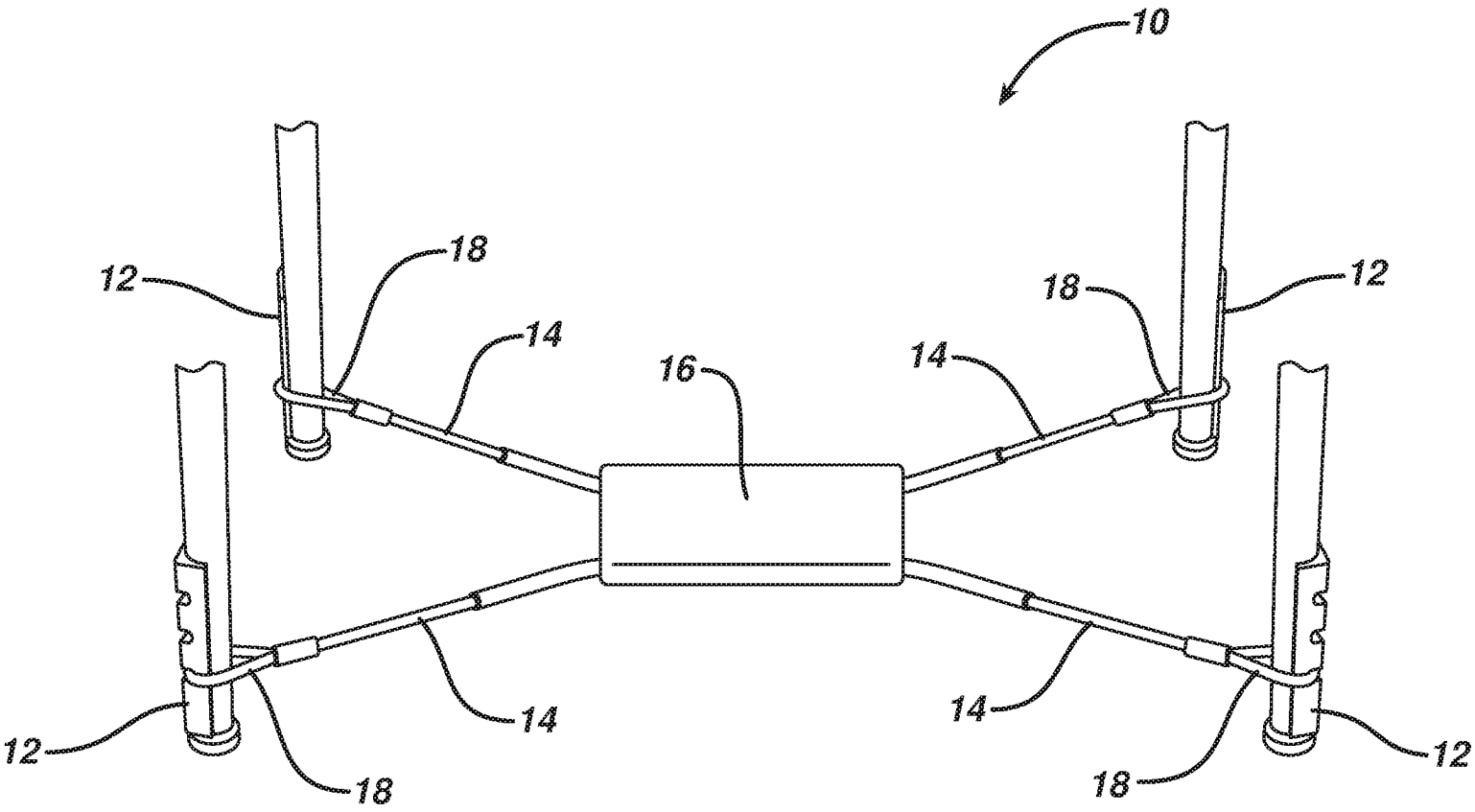
FIG. 2 is perspective view, from above, of the physical activity device shown in FIG. 1 and the tubular support members to which it is attached.

A physical activity device 10 according to one implementation is shown in FIGS. 1-2. Physical activity device 10 includes four sleeves 12 and a pair of elastic cords 14A, 14B that support a central footrest 16. Each of the elastic cords terminates in a loop 18 that is placed around a tubular support member 20 (e.g., a leg) of the table or desk 2 and held in a predetermined vertical position above the floor by grooves in the sleeves as will be discussed in detail below. The footrest 16 couples the two elastic cords, and can be, for example, a plastic tube or other element having a hollow interior through which the cords can pass. It is generally preferable that the cords be able to slide freely within the footrest. Each cord may include a sheath 22 to protect the cord where it extends through the central footrest.

Figure 3:
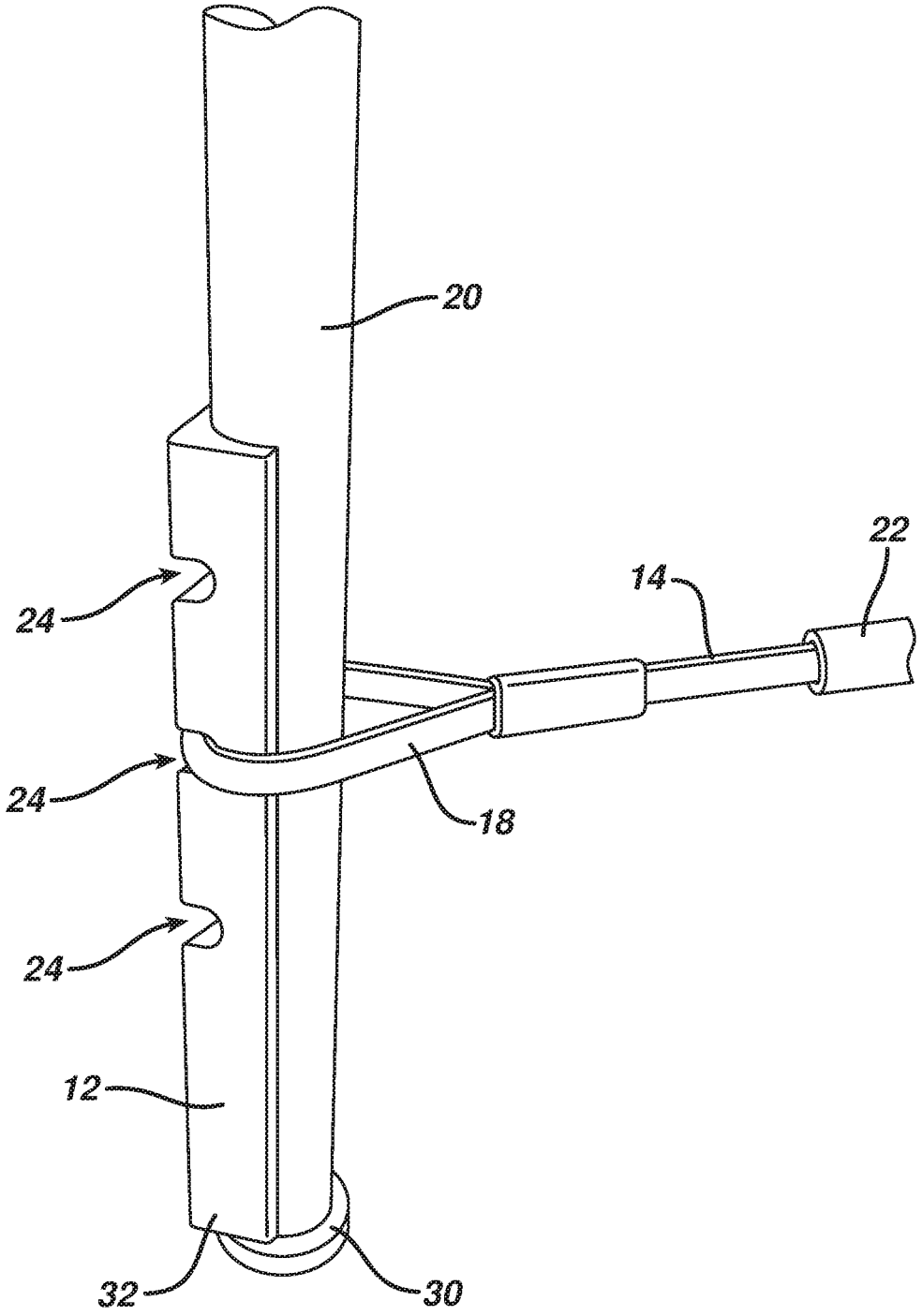
FIG. 3 is an enlarged perspective view of a single sleeve of the physical activity device and a loop engaged with the sleeve.

Referring now to FIG. 3, sleeve 12 includes three grooves 24 that are spaced at regular intervals along the length of the sleeve. The vertical position of the grooves corresponds to the vertical positions that are commonly preferred by users. Referring to FIG. 4C, in the embodiment shown the spacing between the grooves ($S_g$) can be, for example, from about 1 to 2 inches, e.g., from about 1.25 to 1.75 inches. The spacing between the upper groove and the top of the sleeve ($S_t$) is generally selected to minimize the weight of the sleeve by avoiding the use of excess material, while still providing the sleeve with adequate structural integrity. $S_t$ may be, for example, about 0.75 to 1.5 inches. The length from the lower (in use) end of the sleeve to the first groove (Lg) can be, for example, from about 3 to 5 inches, e.g., from about 3.5 to 4.5 inches. This dimension is generally selected to be high enough so that the footrest will not bottom out on the floor or ground during use. The overall length of the sleeve (L) may be, for example, at least 6 inches, e.g., from about 6 to 10 inches, or from about 7 to 9 inches. The grooves 24 generally all have the same diameter (D), which is selected to be slightly larger than the diameter of the elastic cord. In some implementations D may be, for example, from about 0.25 to 0.5 inch, e.g., from about 0.35 to 0.45 inch. The radius of curvature of the inner surface is generally very slightly greater than the radius of curvature of the leg with which the sleeve will be used, e.g., 1.01 for a 1 inch diameter leg.

Figure 4:
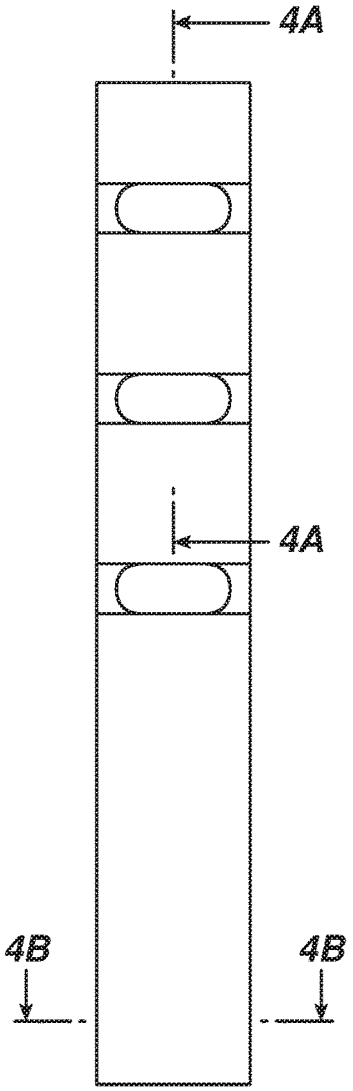
FIG. 4 is a front plan view of the sleeve.
Figure 4A:
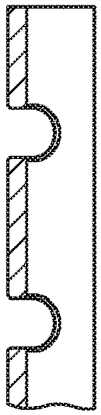
FIGS. 4A and B are cross-sectional views taken along lines A-A and B-B, respectively.
Figure 4B:
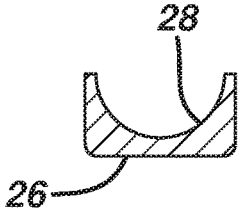
FIG. 4C is a side plan view of the sleeve.
Figure 4C:
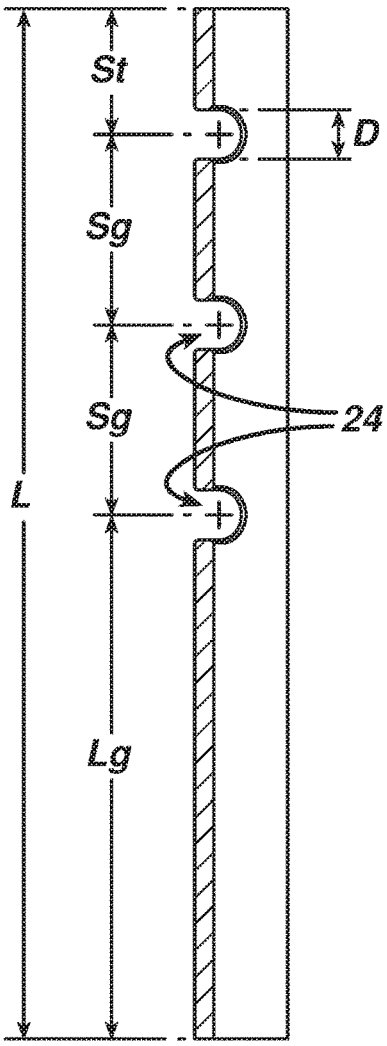

Referring to FIG. 4B, the sleeve has an outer wall 26 that is generally polygonal (in the embodiment shown, a rectangle that is open at one end and that is equal to half of a square.) The edges of the outer square cross-sectional shape bear against the material of the loop to hold the loop securely in place at two lateral points.

The inner wall 28 of the sleeve has a cross-sectional shape in the form of a half circle, allowing the inner wall to contact or partially contact the outer surface of the tubular support members 20.

The radius of the inner wall is generally selected so that the sleeve will extend a little more than halfway around the circumference of tubular support member 20, e.g., from about 0.5 to 15%, e.g., 1 to 5%, more than halfway around the circumference. This allows the sleeve to be easily applied to the leg using a lateral motion (holding the sleeve generally vertical and moving the sleeve into contact with the leg from the side). Once the sleeve is in place and the loops are placed around each of the sleeves the spring force of the elastic cords urges the sleeves against the adjacent outer surfaces of the tubular support members.

Referring again to FIG. 3, in applications in which the legs 20 include swivel feet 30 the sleeve 12 is positioned so that its lower surface 32 rests on the swivel foot 30. The bottom of the sleeve resting on the swivel foot makes it easy to move the desk without disturbing the positioning of the sleeve. If no swivel foot is present, the sleeve will rest on the floor. Having the bottom surface of the sleeve resting on the foot or floor prevents the sleeve from sliding down the leg in response to downward pressure exerted by the user on the footrest.

The sleeves may be manufactured, for example, from a thermoplastic such as polypropylene. The sleeve needs to have sufficient rigidity such that the sleeves together will be able to support the downward force applied to the footrest by a user's foot. The weight applied to the footrest will generally not be the full weight of the user, but could be considerable, for example at least 50 pounds or in some cases 100 pounds or more. It is important that the sleeves not collapse or deflect under normal forces that will be encountered during use.

It is also preferred that the sleeve material have some flexibility, to allow it to give when pressed onto the leg without cracking or permanent deformation of the plastic.

The thermoplastic may be filled, e.g., with cellulose fibers, glass fibers, or other fillers, and may include additives to provide a desired level of flexibility without compromising the structural integrity of the sleeves.

Use of the Physical Activity Device

The physical activity device can be used, for example, while sitting at a desk, or while standing at a standing desk or table. The sleeves described herein can be used with any of the embodiments described in U.S. Pat. No. 8,434,824, incorporated by reference above.

The physical activity device can be attached to a walker, a workstation, a desk, or any piece of furniture that provides for enough clearance from the floor or ground to allow the physical activity device to rotate, vibrate, or move in a variety of directions without hitting the floor or the ground.

The height of the footrest 16 above the floor or ground can be easily adjusted simply by moving the loops from one groove to another. Generally, all four loops will be positioned in grooves at the same height, for ergonomic use of the device.

The device can also be easily removed from one desk and taken to another, or stored until the next use, simply by stretching the elastic cords slightly so that the sleeves can be removed from the legs and then removing the sleeves with a lateral movement and sliding the loops off of the legs.

The device may also be used with the 'Standing Desk Conversion Kit' described in U.S. Pat. No. 8,434,824. This kit allows schools to recycle their desk tops by replacing the short desk legs with custom leg extensions to provide a standing desk.

Other Embodiments

Figure 5:
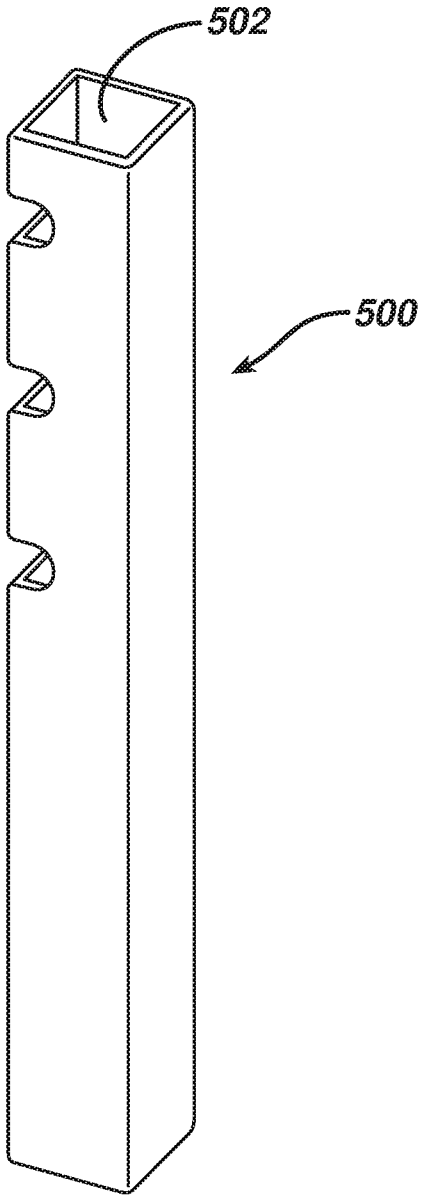
FIG. 5 is a perspective view of a sleeve according to an alternate implementation.

In an alternate embodiment, the device can include sleeves that fully enclose the leg and slide on by lifting up the desk or table and sliding the sleeve up from the foot of the tubular support member. This embodiment is generally less desirable, in that it is heavier for a given material and somewhat more cumbersome to attach to the tubular support member. However, it may be desirable in some cases, e.g., where a particularly secure attachment is desired, a tubular support member having a diameter larger than 1" is involved, or when a square leg is used rather than a tubular support member. The inner wall may in some cases be square in cross-section, for example sleeve 500 as shown in FIG. 5 the inner surface 502 of which is square in cross-section, or may be round or oval in cross-section. The sleeve could also have a circular outer cross-section if desired. The inner wall of the sleeve is dimensioned to allow the sleeve to be slipped over the leg, and thus if the leg includes a swivel foot the inner dimensions of the sleeve must be sufficient to allow it to clear the foot. Thus, in this embodiment the sleeve may need to rest on the ground or floor, around the foot, rather than resting on the foot.

In other alternate embodiments, the sleeves may have more or fewer than three grooves, and/or the device may include more or fewer than four sleeves.

Moreover, the two elastic cords may be replaced by four separate cords that are joined at the central footrest, or one long cord that is appropriately fitted through the footrest such that it forms an "eight" having two loops each of which is stretched around two of the tubular supports.

In some cases, if the fit between the sleeve and tubular support member is not close enough, or it is desired to keep the sleeves in place when the loops are removed, additional elements may be provided to secure the sleeves. For example, clips or straps may be provided to wrap around a portion of the sleeve and snug it up against the tubular support.

Accordingly, other embodiments are within the scope of the following claims.

What is claimed is:

1. A physical activity device comprising:

a central footrest, configured to receive at least a portion of a foot of a user, a plurality of elongated sleeves, each sleeve being open at the top and having an inner and an outer surface, each sleeve being configured to partially enclose an elongated tubular support member, such that the sleeve extends only partially around the circumference of the tubular member and thus is removable from the tubular support member without axial movement of the sleeve, and each sleeve having spaced recessed grooves in its outer surface extending generally perpendicular to a longitudinal axis of the sleeve, and at least two elastic cords supporting the footrest, the cords terminating in loops that are received by the grooves when the device is in use so that the sleeves support the footrest above a surface on which the tubular support members are positioned.

2. The physical activity device of claim 1 wherein each sleeve is configured to extend around from about 45 percent to 55 percent of the circumference of the tubular support member.

3. The physical activity device of claim 1 wherein the tubular support member is a leg of a desk or table.

4. The physical activity device of claim 3 wherein the leg includes a swivel foot, and each sleeve is configured to rest on the swivel foot.

5. The physical activity device of claim 1 wherein each sleeve has an outer surface the cross-section of which is an open rectangle or square, and an inner surface that is arcuate in cross-section.

6. The physical activity device of claim 5 wherein the cross-sectional shape of the inner surface is a semicircle and the outer surface is a half square.

7. The physical activity device of claim 1 wherein each sleeve includes at least three grooves.

8. The physical activity device of claim 1 wherein the device includes four sleeves and the loops provide four attachment points when the loops are positioned in the grooves.

9. The physical activity device of claim 1 wherein the grooves are spaced from 1 to 2 inches apart.

10. The physical activity device of claim 1 wherein each sleeve is from about 6 to 10 inches long.

11. The physical activity device of claim 1 wherein the footrest is hollow and the elastic cords extend through the footrest.

12. The physical activity device of claim 1 wherein the loops are positioned within the grooves during use.

13. A physical activity device comprising:

a central footrest, configured to receive at least a portion of a foot of a user, a plurality of elongated sleeves, each sleeve being open at the top and comprising a linear member having a longitudinal axis that extends parallel to an elongated tubular support member with which the sleeve is in contact during use of the device, and each sleeve having spaced recessed grooves in an outer surface of the sleeve, the grooves extending generally perpendicular to the longitudinal axis of the sleeve, and at least two elastic cords supporting the footrest, the cords terminating in loops that are received by the grooves when the device is in use so that the sleeves support the footrest above a surface on which the tubular support members are positioned.

14. The physical activity device of claim 13 wherein each sleeve is configured to extend only partially around the circumference of the tubular support member.

15. The physical activity device of claim 14 wherein each sleeve is configured to extend around from about 45 percent to 55 percent of the circumference of the tubular support member.

16. The physical activity device of claim 13 wherein the tubular support member is a leg of a desk or table.

17. The physical activity device of claim 16 wherein the leg includes a swivel foot, and each sleeve is configured to rest on the swivel foot.

18. The physical activity device of claim 13 wherein each sleeve has an outer surface the cross-section of which is an open rectangle or square, and an inner surface that is arcuate in cross-section.

19. The physical activity device of claim 16 wherein the cross-sectional shape of the inner surface is a semicircle and the outer surface is a half square.

20. The physical activity device of claim 13 wherein the device includes four sleeves and the loops provide four attachment points when the loops are positioned in the grooves.

21. A method comprising:

attaching a physical activity device having a central footrest to a support structure having three or more vertically extending tubular support members, by (a) placing an elongated sleeve around each of the support members, each elongated sleeve being open at the top and having an inner and an outer surface, and the sleeve being configured to partially enclose the support member and thus be removable from the tubular support member without axial movement of the sleeve, the outer surface of the sleeve including two or more grooves extending generally perpendicular to a longitudinal axis of the sleeve, and (b) placing a loop of an elastic cord that is supported by the footrest around each of the sleeves such that the loop is retained in one of the grooves and the footrest is supported above a surface on which the tubular support members are positioned.

22. The method of claim 21 wherein each loop is placed in a groove at the same vertical height above a surface on which the support structure is positioned.

23. The method of claim 21 wherein each sleeve is open on one side and is mounted on the support member using a lateral motion relative to a longitudinal axis of the support member.

24. The method of claim 21 further comprising adjusting the height of the footrest relative to a surface on which the support structure is positioned by moving the loops to different grooves in each sleeve.

25. The method of claim 21 wherein the support members include swivel feet, and the sleeves are placed on the support members such that a lower terminal surface of each sleeve rests on an upper surface of the corresponding swivel foot.

26. The method of claim 21 further comprising removing the physical activity device from the support structure by removing the sleeves from the support members.

* * * * *